US009142903B2

(12) United States Patent
McGrath, Jr. et al.

(10) Patent No.: US 9,142,903 B2
(45) Date of Patent: Sep. 22, 2015

(54) HIGH PERFORMANCE MULTIPORT CONNECTOR SYSTEM USING LIGA SPRINGS

(71) Applicant: Tektronix, Inc., Beaverton, OR (US)

(72) Inventors: James H. McGrath, Jr., Aloha, OR (US); Ira Pollock, Hillsboro, OR (US); David W. Simmen, Portland, OR (US)

(73) Assignee: TEKTRONIX, INC., Beaverton, OR (US)

( * ) Notice: Subject to any disclaimer, the term of this patent is extended or adjusted under 35 U.S.C. 154(b) by 102 days.

(21) Appl. No.: 14/088,241

(22) Filed: Nov. 22, 2013

(65) Prior Publication Data

US 2015/0147922 A1 May 28, 2015

(51) Int. Cl.
*H01R 13/62* (2006.01)
*H01R 13/15* (2006.01)

(52) U.S. Cl.
CPC ..... *H01R 13/15* (2013.01)

(58) Field of Classification Search
CPC ..... H01R 12/82; G01R 1/04
USPC ..... 439/862, 482, 310; 324/538
See application file for complete search history.

(56) References Cited

U.S. PATENT DOCUMENTS 5,234,353 A * 8/1993 Scholz et al. ..... 439/289
5,701,079 A * 12/1997 Yagi et al. ..... 324/538
5,735,709 A * 4/1998 Hashiguchi et al. ..... 439/495
5,846,097 A * 12/1998 Marian, Jr. ..... 439/289
6,152,754 A * 11/2000 Gerhardt et al. ..... 439/325
6,480,005 B2 * 11/2002 Nagano et al. ..... 324/538
6,524,124 B2 * 2/2003 Yamane ..... 439/260
7,828,570 B2 * 11/2010 Suzuki et al. ..... 439/260
2012/0238158 A1 9/2012 Yoshida et al.
2015/0024619 A1 1/2015 Thies et al.

FOREIGN PATENT DOCUMENTS

DE 202012001645 U1 5/2013

OTHER PUBLICATIONS

Extended European Search Report for European Patent Application No. 14194243.3 , dated Apr. 15, 2015, pp. 8.

* cited by examiner

*Primary Examiner* — Vanessa Girardi
(74) *Attorney, Agent, or Firm* — Marger Johnson

(57) ABSTRACT

A multiport zero insertion force (ZIF) connector can include a multiport connector housing defining an opening and an interior space for receiving a multi-path circuit device having multiple types of electrical connection paths therethrough and multiple LIGA springs positioned within the interior space to apply pressure to the multi-path circuit device while in a first position. A locking component can be configured to cause the LIGA springs to move to a second position responsive to a user pressing the locking component, wherein the LIGA springs do not apply pressure to the multi-path circuit device while in the second position.

20 Claims, 3 Drawing Sheets

HIGH PERFORMANCE MULTIPORT CONNECTOR SYSTEM USING LIGA SPRINGS

TECHNICAL FIELD

This disclosure relates to signal processing systems and, more particularly, to connectors for such systems.

BACKGROUND

Next generation high-bandwidth probes and future generations of active probes for test systems will require the ability to handle multiple signals at the tip while meeting bandwidth and noise specifications. Current probes require two coaxial signals with frequency performance of up to 33 GHz and up to six direct current (DC) signal lines. Lower performance active probes will require up to eight signal lines and lower bandwidth. Current custom interconnect systems use off-the shelf radio frequency (RF) and DC contacts along with a custom housing. However, such multiport connectors (i.e., hybrid RF and DC) need to be custom designed and built for each probe application and, consequently, are very expensive—often prohibitively so.

Accordingly, a need remains for a high-performance, multiport connector system.

DETAILED DESCRIPTION

Radio frequency (RF) connector suppliers have been developing a process to create high performance micro-springs. Such springs are typically fabricated by way of a process referred to herein as "LIGA" (which is short for Lithographie, Galvanoformung, and Abformung). LIGA processing generally consists of three main processing steps: lithography, electroplating, and molding. There are two main types of LIGA-fabrication technologies: x-ray LIGA, which uses X-rays produced by a synchrotron to create high-aspect ratio structures, and ultraviolet (UV) LIGA, which is a more accessible method that uses UV light to create structures having relatively low aspect ratios.

Embodiments of the disclosed technology are generally directed to the use of LIGA springs as part of a new interconnect system for probing applications that would allow for multiple signal types while being flexible and miniature in size while reducing the cost thereof from that of a typical RF connector system. Given the small size and significant range of performance, such an interconnect system could be standardized for an entire probe platform, thus allowing for a common set of probe accessories across multiple product lines.

Figure 1:
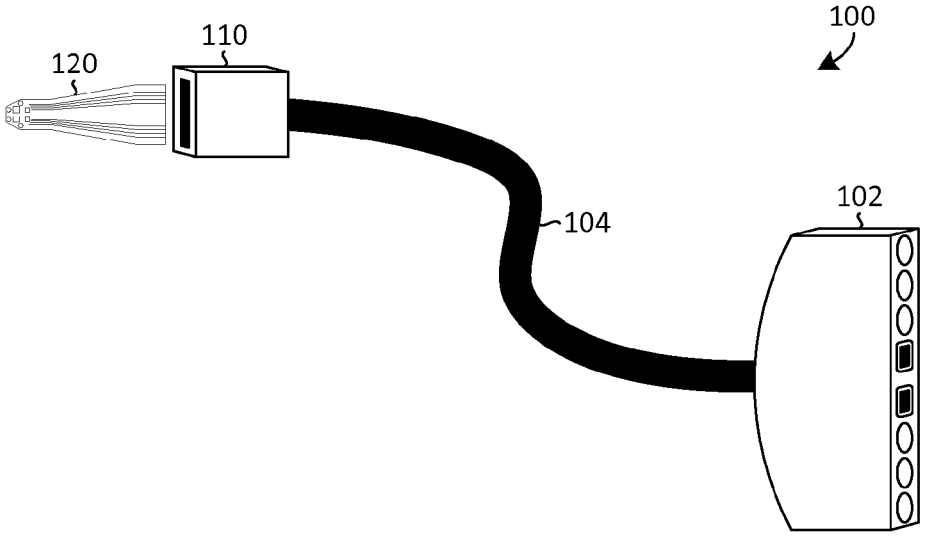
FIG. 1 illustrates an example of a multiport interconnect system in accordance with certain embodiments of the disclosed technology.

FIG. 1 illustrates an example of a multiport interconnect system 100 in accordance with certain embodiments of the disclosed technology. In the example, the system 100 includes a first connector 102 suitable for connecting to an electronic device such as an oscilloscope.

The system 100 also includes a zero insertion force (ZIF) connector 110, e.g., a high-bandwidth connector, suitable for connecting to a circuit device 120 such as a flex circuit that may include multiple contact paths, for example. The circuit device 120 may be suitable for connecting to a device under test (DUT), for example. In this manner, engineers may debug a particular circuit on a circuit board of the DUT.

A connecting member 104, such as a bundle including coaxial cables and/or direct current (DC) lines, may be integrated with the first connector 102 and the ZIF connector 110 to provide electrical coupling between the first connector 102 and the ZIF connector 110.

The ZIF connector 110 may have positioned therein multiple LIGA springs that are suitable for establishing and maintaining electrical contact with portions, e.g., connection points, of the circuit device 120 so long as the circuit device 120 is engaged with, e.g., remains inserted in, the ZIF connector 110.

Figure 2:
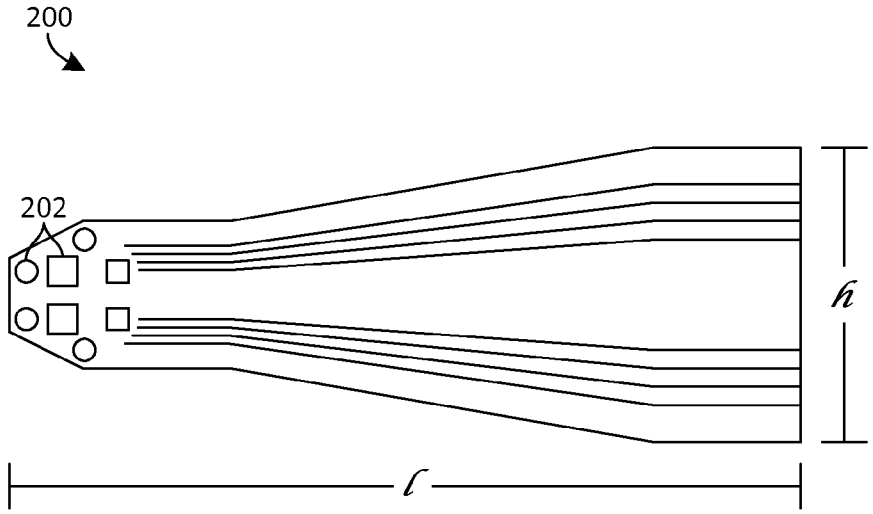
FIG. 2 illustrates an example of a circuit device, such as the circuit device of FIG. 1, in accordance with certain embodiments of the disclosed technology.

FIG. 2 illustrates an example of a circuit device 200, such as the circuit device 120 of FIG. 1, in accordance with certain embodiments of the disclosed technology. In certain embodiments, the circuit device 200 may have a height h of approximately 1 cm and a length/of approximately 3 cm, though both dimensions may be varied and would essentially be limited only by any restrictions with regard to a corresponding slot opening in the ZIF connector 110.

In the example, the circuit device 200 has multiple connection points 202 that may be used to establish and maintain multiple a multiport connection through the circuit device to a DUT, for example, at one end and an electronic device such as an oscilloscope, for example, at the other end. Such internal contacts may be modified to accommodate a wide range of contact types (e.g., DC, power, and high bandwidth) so long as they stay within the contact area. Using custom, configurable, high performance LIGA springs to establish electrical connections advantageously provide a multiport connector that is flexible, configurable, high performance, small in size, robust (improved cycle life), and significantly lower in cost.

In certain embodiments, a DUT may have multiple circuit devices attached thereto such that a user may quickly and efficiently test various portions or aspects of the DUT by connecting a ZIF connector to—and acquiring data from—any or all of the circuit devices one at a time, e.g., sequentially.

Figure 3:
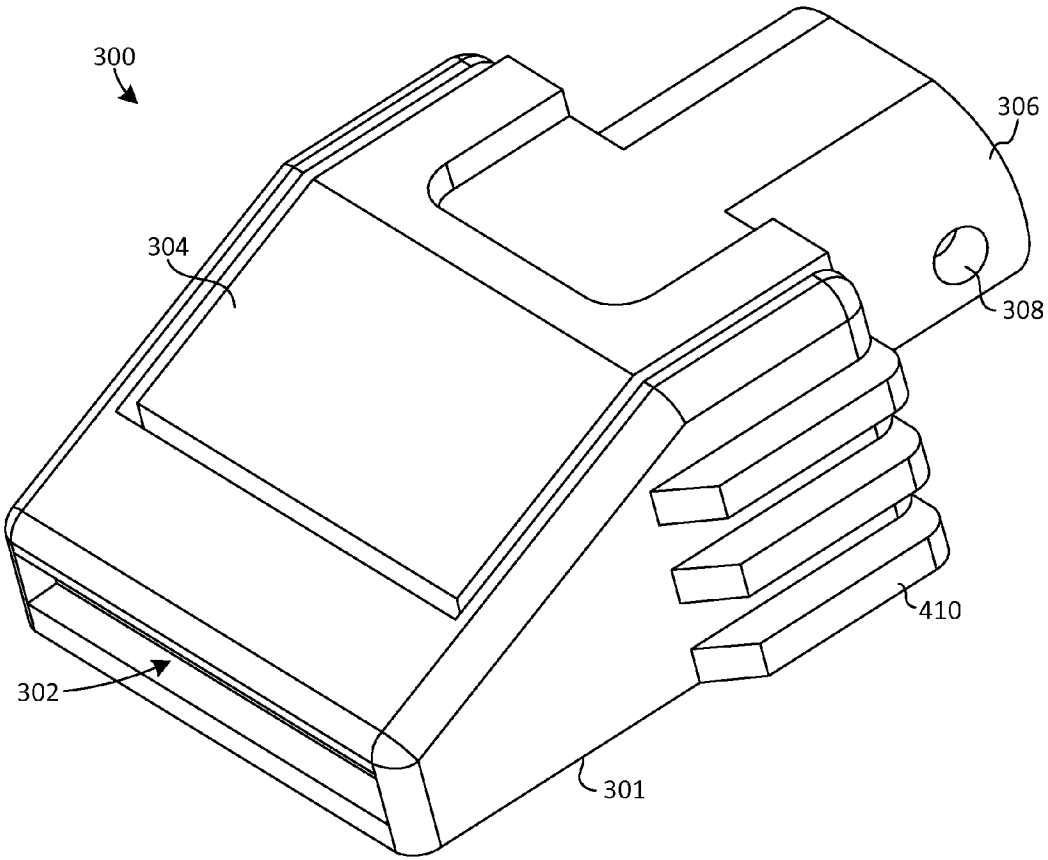
FIG. 3 illustrates an example of a ZIF connector, such as the ZIF connector of FIG. 1, in accordance with certain embodiments of the disclosed technology.

FIG. 3 illustrates an example of a ZIF connector 300, such as the ZIF connector 110 of FIG. 1, in accordance with certain embodiments of the disclosed technology. In the example, the ZIF connector 300 has a housing 301, e.g., a metal housing, that defines an opening 302, e.g., a slotted opening, and an interior space that are both suitable for receiving a mating member, e.g., a circuit device such as the circuit device 120 of FIG. 1.

The ZIF connector 300 has a locking component 304 suitable for facilitating the mating of the mating member, e.g., a circuit device, with the ZIF connector 300. In certain embodiments, a user may press the locking component 304 and, responsive thereto, multiple LIGA springs positioned within the interior space may move or be caused to be moved to an "open" position such that the user (or another party) may easily insert the mating member through the opening 302 and into the interior portion of the ZIF connector 300.

Responsive to the user releasing the locking component 304, the LIGA springs positioned in the interior space may move or be caused to be moved to a "closed" positioned such that they make contact with—while concurrently applying pressure to—the mating member. In certain embodiments, the LIGA springs may also establish at least one electrical connection with the mating member and maintain the electrical connection(s) so long as the mating member remains secured within—and mated with—the ZIF connector 300.

In the example, the ZIF connector 300 includes a rear portion 306 suitable for receiving—or otherwise mating with—a connecting member such as the connecting member 104 of FIG. 1. The rear portion 306 may include an optional side hole 308 or multiple side holes suitable to be used as an attachment point for accessories such as active probe tips, passive probe tips, and browsers, for example. In place of or in addition to the side hole(s) 308, optional support ribs 310 may be used as an attachment point for accessories such as those noted above.

Figure 4:
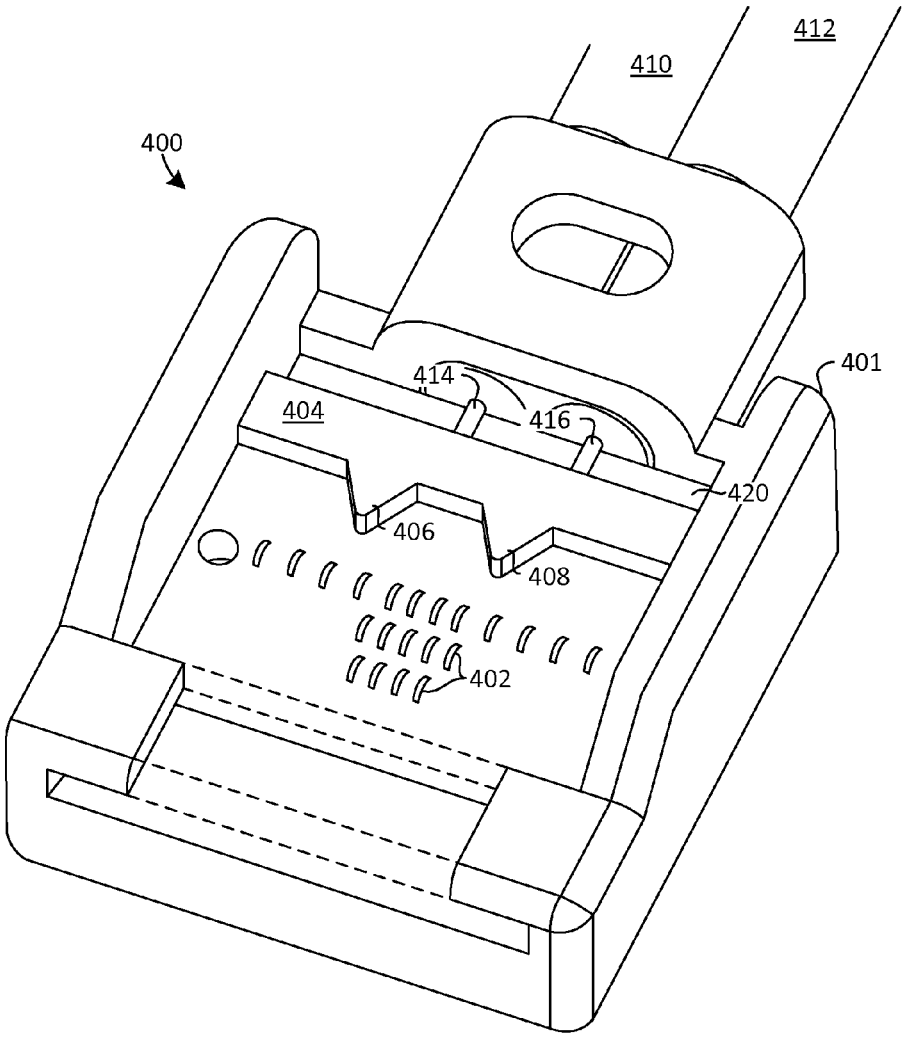
FIG. 4 illustrates a cutaway view of a ZIF connector, such as the ZIF connector of FIG. 3, in accordance with certain embodiments of the disclosed technology.

FIG. 4 illustrates a cutaway view of a ZIF connector 400, such as the ZIF connector 300 of FIG. 3, in accordance with certain embodiments of the disclosed technology. In the cutaway example, one can see multiple LIGA springs 402 within a housing 401, e.g., a metal housing, of the ZIF connector 400.

The LIGA springs 402 may include DC springs, signal springs, ground springs, or any suitable combination thereof. Any or all of the LIGA springs 402 may have a generally helical shape, a cantilever shape, or a combination thereof depending on the production process used and/or intended application of the ZIF connector, for example.

Also within the ZIF connector 400 is a spring housing 404 and multiple positioning portions 406 and 408 (also referred to herein as positioning keys) configured to align a mating member, such as a circuit device, within the interior portion of the ZIF connector 400 while the mating member is within the interior portion. While the example illustrates two positioning portions 406 and 408, certain embodiments may include more than two positioning portions.

Two connecting members 410 and 412 serve to provide an electrical connection between the ZIF connector 400 and another connector such as the first connector 102 of FIG. 1, for example. In the example, the connecting members 410 and 412 are coaxial lines having corresponding coaxial launches 414 and 416, respectively, that may serve to electrically couple with a circuit board 420 that is situated underneath the LIGA springs 402 and the spring housing 404. In other embodiments, there may be more than two connecting members, e.g., two coaxial lines and six to eight DC lines, connecting the ZIF connector 400 to the other connector.

Having described and illustrated the principles of the invention with reference to illustrated embodiments, it will be recognized that the illustrated embodiments may be modified in arrangement and detail without departing from such principles, and may be combined in any desired manner. And although the foregoing discussion has focused on particular embodiments, other configurations are contemplated. In particular, even though expressions such as "according to an embodiment of the invention" or the like are used herein, these phrases are meant to generally reference embodiment possibilities, and are not intended to limit the invention to particular embodiment configurations. As used herein, these terms may reference the same or different embodiments that are combinable into other embodiments.

Consequently, in view of the wide variety of permutations to the embodiments described herein, this detailed description and accompanying material is intended to be illustrative only, and should not be taken as limiting the scope of the invention. What is claimed as the invention, therefore, is all such modifications as may come within the scope and spirit of the following claims and equivalents thereto.

We claim:

1. A multiport zero insertion force (ZIF) connector for test and measurement devices, comprising:

a multiport connector housing defining an opening and an interior space suitable for receiving a multi-path circuit device having multiple types of electrical connection paths therethrough;

a plurality of LIGA springs positioned within the interior space and configured to apply pressure to the multi-path circuit device while in a first position, wherein each of the plurality of LIGA springs facilitates an electrical connection between one of a plurality of connection points on the multi-path circuit device and a test/measurement instrument; and a locking component configured to cause the plurality of LIGA springs to move to a second position responsive to a user pressing the locking component, wherein the plurality of LIGA springs do not apply pressure to the multi-path circuit device while in the second position.

2. The multiport ZIF connector of claim 1, wherein the locking component is further configured to cause the plurality of LIGA springs to move back to the first position responsive to the user releasing the locking component.

3. The multiport ZIF connector of claim 1, wherein the plurality of LIGA springs remain in the second position so long as the user continues to press the locking member.

4. The multiport ZIF connector of claim 1, wherein each of the plurality of LIGA springs has a generally helical shape or a cantilever shape.

5. The multiport ZIF connector of claim 1, wherein the plurality of LIGA springs are generated by way of an x-ray fabrication technique.

6. The multiport ZIF connector of claim 1, wherein the plurality of LIGA springs are generated by way of an ultraviolet (UV) light fabrication technique.

7. The multiport ZIF connector of claim 1, further comprising a plurality of positioning portions within the interior space, wherein the plurality of positioning portions are configured to align the multi-path circuit device within the interior space.

8. The multiport ZIF connector of claim 1, wherein the test/measurement instrument is an oscilloscope.

9. The multiport ZIF connector of claim 1, wherein the opening is a slotted opening.

10. The multiport ZIF connector of claim 9, wherein the circuit device is a flex circuit.

11. The multiport ZIF connector of claim 1, further comprising a rear portion configured to receive a connecting member.

12. The multiport ZIF connector of claim 11, wherein the rear portion defines at least one side hole configured to be used as an attachment point for an accessory.

13. The multiport ZIF connector of claim 11, further comprising a plurality of support ribs integrated with the rear portion, wherein the plurality of ribs is configured to be used as an attachment point for an accessory.

14. The multiport ZIF connector of claim 11, wherein the connecting member includes at least one coaxial line, at least one direct current (DC) line, or both at least one coaxial line and at least one DC line.

15. The multiport ZIF connector of claim 14, wherein the connecting member includes two or more connecting members and further wherein a protective encasing encases the two or more connecting members.

16. A multiport interconnect system, comprising:

a device under test (DUT);

a multi-path circuit device that is physically and electrically coupled with the DUT; and a zero insertion force (ZIF) connector electrically coupled with the DUT, the ZIF connector including:

a connector housing defining an opening and an interior space suitable for receiving the mating member;

a plurality of LIGA springs positioned within the interior space and configured to apply pressure to the mating member while in a first position, wherein each of the plurality of LIGA springs facilitates an electrical connection between one of a plurality of connection points on the multi-path circuit device and a test/measurement instrument; and a locking component configured to cause the plurality of LIGA springs to move to a second position responsive to a user pressing the locking component, wherein the plurality of LIGA springs do not apply pressure to the mating member while in the second position.

17. The multiport interconnect system of claim 16, wherein the test instrument is an oscilloscope.

18. The multiport interconnect system of claim 16, wherein the mating member is a flex circuit.

19. The multiport interconnect system of claim 16, further comprising a plurality of connecting members electrically coupled between the ZIF connector and the test instrument.

20. The multiport interconnect system of claim 16, wherein the test/measurement instrument is an oscilloscope.

* * * * *